US006901912B1

(12) United States Patent
Onishi et al.

(10) Patent No.: US 6,901,912 B1
(45) Date of Patent: Jun. 7, 2005

(54) VARIABLE DELIVERY FUEL SUPPLY DEVICE

(75) Inventors: Yoshihiko Onishi, Tokyo (JP); Masayasu Miyajima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 521 days.

(21) Appl. No.: 09/593,146

(22) Filed: Jun. 14, 2000

(30) Foreign Application Priority Data

Mar. 1, 2000 (JP) ..... 2000-055337

(51) Int. Cl.[7] ..... F02M 41/00
(52) U.S. Cl. ..... 123/456; 123/447; 123/506
(58) Field of Search ..... 123/506, 447, 123/467, 495, 456, 514

(56) References Cited

U.S. PATENT DOCUMENTS

| | | | | | |
|---|---|---|---|---|---|
| 5,564,394 | A | * | 10/1996 | Wood | 123/506 |
| 5,749,717 | A | * | 5/1998 | Straub et al. | 417/505 |
| 6,009,858 | A | * | 1/2000 | Teerman | 123/506 |
| 6,053,712 | A | * | 4/2000 | Konishi et al. | 417/540 |
| 6,058,912 | A | * | 5/2000 | Rembold et al. | 123/516 |
| 6,102,010 | A | * | 8/2000 | Isozumi et al. | 123/506 |
| 6,135,093 | A | * | 10/2000 | Kikuchi et al. | 123/467 |
| 6,213,094 | B1 | * | 4/2001 | Onishi et al. | 123/447 |
| 6,223,725 | B1 | * | 5/2001 | Onishi et al. | 123/447 |
| 6,321,719 | B1 | * | 11/2001 | Schwegler | 123/467 |
| 6,345,609 | B1 | * | 2/2002 | Djordjevic | 123/509 |

FOREIGN PATENT DOCUMENTS

| | | | | |
|---|---|---|---|---|
| EP | 0905372 | * | 3/1999 | 123/456 |
| JP | 10-176625 | | 6/1998 | |
| JP | 11-200990 | | 7/1999 | |

* cited by examiner

*Primary Examiner*—Carl S. Miller
(74) *Attorney, Agent, or Firm*—Sughrue Mion, PLLC

(57) ABSTRACT

A variable delivery fuel supply device capable of obtaining a stable fuel supply without causing noises resulted from the operation of the electromagnetic valve or a defect of the strength of a supply passage for flowing fuel of low pressure, which comprises fuel injection valves 1*a*–1*d* for injecting fuel to respective cylinders of an internal combustion engine, a fuel pump 3 which sucks fuel from a fuel intake port 13 through an intake valve 15 into a pressurizing chamber 24 by a reciprocating movement of a plunger 22 in a cylinder 21 to pressurize the fuel and supplies the pressurized fuel into the fuel injection valves 1*a*14 1*d* through a discharge valve 16, a damper chamber 29 having a pressure damper 30, which is communicated with the fuel passage 14 at a position between the fuel intake port 13 and the intake valve 15 in the fuel pump 3, a relief passage 20 for communicating the pressurizing chamber 24 with the fuel passage 14 in the fuel pump 3 and an electromagnetic valve 19 for opening and closing the relief passage 20, which is adapted to control an amount and a pressure of pressurized fuel to be supplied to the fuel injection valves by relieving pressurized fuel in the pressurizing chamber 24 to the fuel passage 14 at the time of opening the valve.

19 Claims, 4 Drawing Sheets

VARIABLE DELIVERY FUEL SUPPLY DEVICE

BACKGROUND OF THE INVENTION

1. Field of the Invention

The present invention relates to a variable delivery fuel supply device which is used for an internal combustion engine for automobiles, in particular, for a cylinder injection type gasoline engine requiring highly pressurized fuel and which is capable of controlling an amount of fuel to be supplied to fuel injection valves.

2. Discussion of Background

FIG. 4 is a systematic diagram showing the construction of a conventional variable delivery fuel supply device, wherein reference numerals 1*a* through id designate fuel injection valves for injecting fuel into respective cylinders of an internal combustion engine, numeral 2 designates a delivery pipe for supplying fuel to the fuel injection valves 1*a*–1*d*, numeral 3 a fuel pump for supplying pressurized fuel to the delivery pipe 2, numeral 4 a low pressure fuel pump for supplying fuel from a fuel tank 5 to the fuel pump 3, numeral 6 a check valve provided in a fuel passage 7, numeral 8 a low pressure regulator for controlling pressure in the fuel passage 7, numeral 9 a relief valve for relieving fuel from a fuel passage 10 through a fuel passage 11 to the fuel tank 5 when a fuel pressure in the delivery pipe 2 exceeds a predetermined value, and numeral 12 a return passage for returning fuel through the fuel pump 3 to the fuel tank 5.

The fuel pump 3 comprises a cylinder, a plunger performing a reciprocating movement in the cylinder due to a driving action of a cam provided on a cam shaft of the internal combustion engine and a pressurizing chamber for sucking fuel during the reciprocating movement of the plunger to pressurize the fuel, although these structural components are not shown in the drawing. The fuel pump 3 is to receive fuel supplied from the fuel tank 5 through a fuel intake port 13; to feed the fuel into the pressurizing chamber via a fuel passage 14 and an intake valve 15 in a suction step; to supply forcibly the fuel pressurized in the pressurizing chamber to a discharge port 18 via a discharge valve 16 and a fuel pressure maintaining valve 17 in a discharge step; and to supply the fuel to the delivery pipe 2 through the fuel passage 10 whereby the fuel in the delivery pipe 2 is distributed to the respective fuel injection valves 1*a*–1*d*.

Reference numeral 19 designates an electromagnetic valve disposed in the fuel pump 3, which is to open and close a relief passage 20 for communicating the pressurizing chamber (not shown) in the fuel pump 3 with the fuel passage 14. When control means (not shown) detect that a fuel pressure in the delivery pipe 2 reaches a predetermined value, the control means supply a valve-opening signal to the electromagnetic valve 19. Then, the electromagnetic valve 19 is opened to communicate the pressurizing chamber, in which a highly pressurized fuel is stored, with the fuel passage 14 of low fuel pressure to thereby relieve the pressurized fuel. Thus, the fuel pressure in the delivery pipe 2 can be controlled by controlling an amount of fuel discharged from the fuel pump 3. The fuel pressure of the delivery pipe 2 increases since fuel is supplied in a discharge step of the plunger of the fuel pump 3. Accordingly, the valve-opening operation of the electromagnetic valve 19 is conducted in the discharge step.

In the conventional variable delivery fuel supply device having the above-mentioned structure, the discharge performance of the fuel pump 3 is so determined as to cover the fuel consumption rate of the internal combustion engine over the entire operational range. Accordingly, there is allowance in the discharge performance of the fuel pump in a normal state of operation, and the electromagnetic valve 19 is opened at every discharge step whereby the highly pressurized fuel flows in a pulse form in the fuel passage 14. The pulsating flow of the pressurized fuel generates a pulse-like fuel pressure in the fuel passage 14 and the fuel passage 7 as supply passages for fuel of low pressure. The amplitude of a pressure pulsation will increase as a rotating speed of the internal combustion engine is increased, with the result that vibrations are generated in a fuel pipe such as the fuel passage 7 whereby noises are generated and damage is caused in the fuel pipe due to a mechanical stress by the vibrations. Further, the pressure pulsation creates a disturbance flow or cavitation in the passage for supplying fuel of low pressure, which may cause an unstable supply of fuel to the delivery pipe 2 and influences adversely the performance of the internal combustion engine.

SUMMARY OF THE INVENTION

It is an object of the present invention to provide a variable delivery fuel supply device capable of supplying stably fuel to an internal combustion engine without causing noises and a danger of the breaking of a fuel passage for feeding fuel of low pressure when an electromagnetic valve is operated to relieve a highly pressurized fuel.

In accordance with the present invention, there is provided a variable delivery fuel supply device which comprises fuel injection valves for injecting fuel to respective cylinders of an internal combustion engine, a fuel pump which sucks fuel from a fuel intake port through an intake valve into a pressurizing chamber by a reciprocating movement of a plunger in a cylinder to pressurize the fuel and supplies the pressurized fuel into the fuel injection valves through a discharge valve, a damper chamber having a pressure damper, which is communicated with a fuel passage at a position between the fuel intake port and the intake valve in the fuel pump, a relief passage for communicating the pressurizing chamber of the fuel pump with the fuel passage, and an electromagnetic valve for opening and closing the relief passage, which is adapted to control an amount of pressurized fuel to be supplied to the fuel injection valves by relieving pressurized fuel in the pressurizing chamber to the fuel passage at the time of opening the valve.

In the above-mentioned invention, the damper chamber having a pressure damper may be formed integrally with the fuel pump.

Further, the relief passage may be communicated with the fuel passage at a position between the damper chamber including a pressure damper and the intake valve.

Further, an orifice may be formed in the relief passage.

Further, the pressure damper may be formed of a metallic bellows or a metallic diaphragm.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENT

Figure 1:
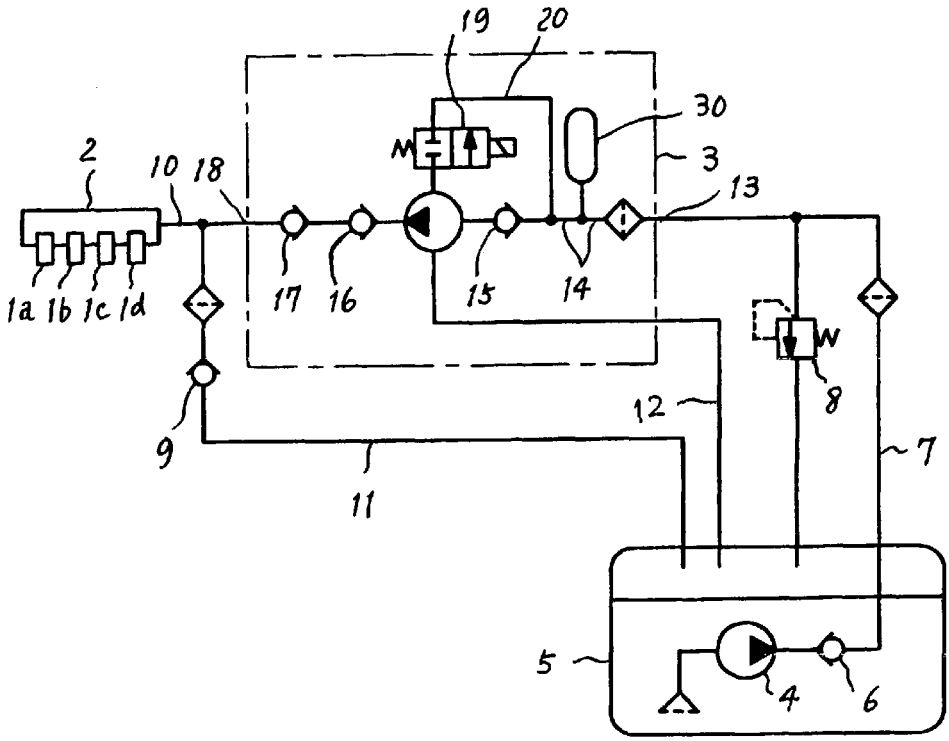
FIG. 1 is a systematic diagram showing the construction of the variable delivery fuel supply device according to a first embodiment of the present invention.

The variable delivery fuel supply device according to a first embodiment of the present invention will be described with reference to FIGS. 1 and 2 wherein the same reference numerals designate the same or corresponding parts.

Embodiment 1

In FIG. 1, reference numerals 1*a* through 1*d* designate fuel injection valves for injecting fuel to the respective cylinders in an internal combustion engine, numeral 2 designates a delivery pipe which supplies fuel to the fuel injection valves 1*a*–1*d*, numeral 3 a fuel pump for supplying pressurized fuel to the delivery pipe 2, numeral 4 a low pressure fuel pump for supplying fuel from a fuel tank 5 to the fuel pump 3, numeral 6 a check valve provided in a fuel passage 7, numeral 8 a low pressure regulator for controlling a pressure in the fuel passage 7, numeral 9 a relief valve to relieve fuel to the fuel tank 5 via a fuel passage 10 and a fuel passage 11 when a fuel pressure in the delivery pipe 2 exceeds a predetermined value and numeral 12 a return passage to return fuel from the fuel pump 3 to the fuel tank 5.

Figure 2:
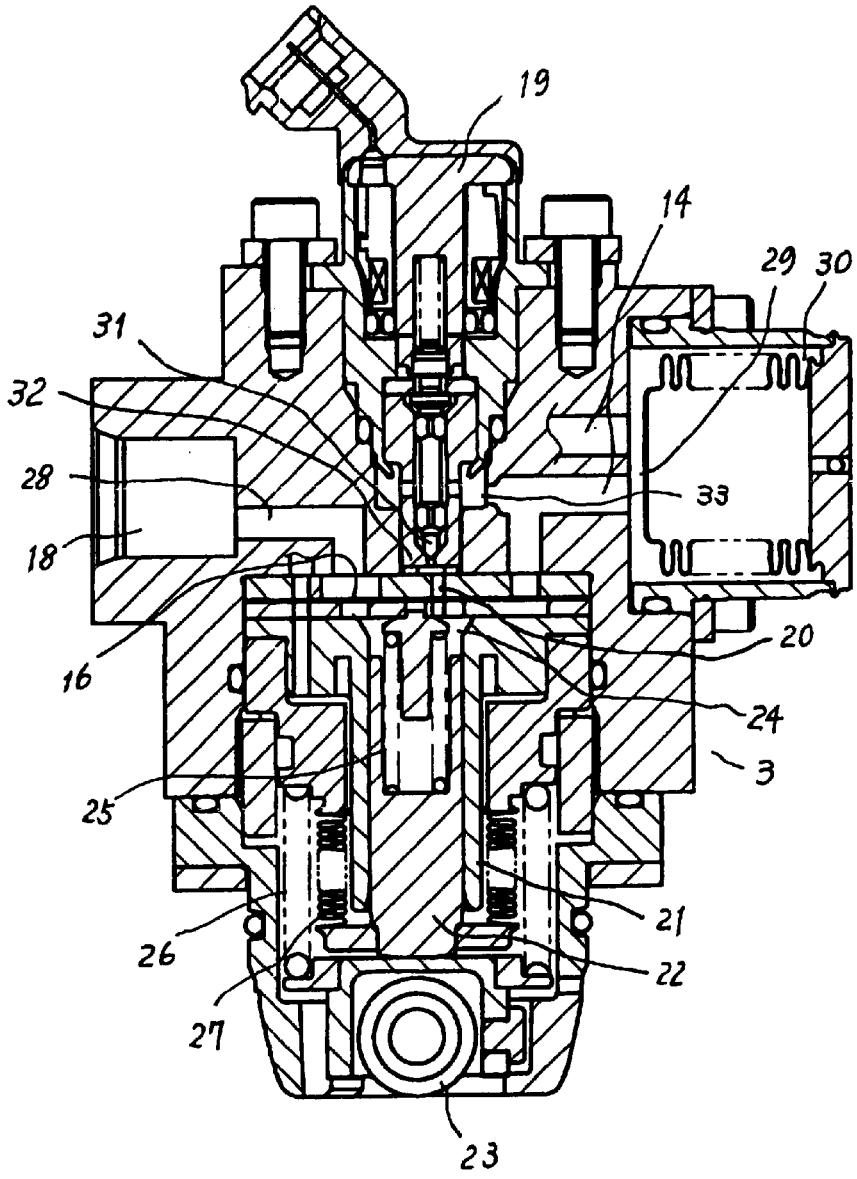
FIG. 2 is a cross-sectional view of a fuel pump used for the variable delivery fuel supply device of the first embodiment of the present invention.

In the fuel pump 3 shown in FIG. 2, reference numeral 21 designates a cylinder, numeral 22 a plunger which performs a reciprocating movement in the cylinder 21 to suck fuel into a pressurizing chamber 24 in which the sucked fuel is pressurized, wherein the plunger is driven by a driving cam of the internal combustion engine (although they are not shown in FIG. 2) by means of a roller 23, numeral 25 a spring for urging always the plunger 22 in a direction of expanding the pressurizing chamber 24, numeral 26 a spring for urging the roller 23 toward a side of the cam shaft (not shown), and numeral 27 a bellows made of metal which is for sealing fuel possibly leaking from a gap between the cylinder 21 and the plunger 22. Numeral 14 designates a fuel passage communicated with a fuel intake port 13 (as shown in FIG. 1). The fuel passage 14 is also communicated with the pressurizing chamber 24 through an intake valve 15. Numeral 18 designates a fuel discharge port connected to the delivery pipe 2 by means of the fuel passage 10. The fuel discharge port 18 is communicated with the pressurizing chamber 24 through a high-pressure fuel passage 28 and a discharge valve 16.

For the driving cam (not shown), a multi-ridge type driving cam having, for instance, 4 ridges, 5 ridges or 6 ridges is used in order to reduce the occurrence of pressure pulsation of fuel in the delivery pipe 2. Accordingly, reed valves having high response characteristics are used for the intake valve 15 and the discharge valve 16.

Numeral 29 designates a damper chamber having a pressure damper 30 formed of a metallic bellows, which maintains a predetermined air pressure. The fuel passage 14 communicated with the fuel intake port 13 is connected to the intake valve 15 and further, the pressurizing chamber 24 via the damper chamber 29. An electromagnetic valve 19 is provided with a valve unit comprising a valve 31 and a valve seat 32, which is adapted to open and close a relief passage 20 communicated with the pressurizing chamber 24 and the fuel passage 14. When the electromagnetic valve 19 is opened, fuel pressurized in the pressurizing chamber 24 flows through the relief passage 20 to the fuel passage 14.

An orifice 33 is formed in the relief passage 20 at a position between the damper chamber 29 communicated with the fuel passage 14 and the intake valve 15, namely, it is opened at a side of a downstream of the fuel passage 14 with respect to the pressure damper 30. With such measures, a possible increase of the amplitude of pressure pulsation caused by the relieving of the pressurized fuel from the electromagnetic valve 19 can be reduced.

In the operation of the variable delivery fuel supply device according to the first embodiment of the present invention, when the low pressure pump 4 is actuated as soon as the internal combustion engine is operated, fuel is supplied from the fuel tank 5 to the fuel pump 3. When the fuel pump 3 is driven by the internal combustion engine, the discharge valve 16 is closed and the intake valve 15 is opened at a suction step of the plunger 22 whereby fuel is sucked into the pressurizing chamber 24 through the fuel intake port 13 and the fuel passage 14, and at a discharge step of the plunger 22, the intake valve 15 is closed and the discharge valve 16 is opened whereby pressurized fuel is supplied forcibly to the delivery pipe 2 via the high pressure fuel passage 28, the fuel discharge port 18 and the fuel passage 10. When the engine is stopped, the fuel pressure in the fuel pump 3 will decrease. However, a fuel pressure maintaining valve 17 is provided in the fuel passage 10 in this embodiment, and therefore, the fuel pressure in the delivery pipe 2 can be maintained for a predetermined time by closing the fuel pressure maintaining valve 17.

When a fuel pressure in the delivery pipe 2 exceeds a predetermined value, the control means detects the fact and supplies a valve-opening signal to the electromagnetic valve 19. Then, the electromagnetic valve 19 is opened to communicate the pressurizing chamber 24, in which a discharge step is conducted, with the fuel passage 14 through the relief passage 20 so that the pressurized fuel in the pressurizing chamber 24 is relieved to the fuel passage 14, and on the other hand, it stops the fuel to discharge to the delivery pipe 2 whereby a fuel pressure in the delivery pipe 2 is maintained to a predetermined value.

In the variable delivery fuel supply device according to the first embodiment of the present invention, since the damper chamber 29 having the pressure damper 30 is communicated with the fuel passage 14, and pressurized fuel is relieved to the fuel passage 14 at the point between the damper chamber 29 and the intake valve 15, a pulsation of the pressurized fuel relieved to the fuel supply passage can be absorbed and relaxed by the pressure damper 30 and a reduced pulsation is applied to the fuel pipe such as the fuel passage 7. Accordingly, the occurrence of noises and a mechanical stress as seen in the conventional device can be minimized. Further, the reduced pressure pulsation suppresses the occurrence of a disturbance of flow or cavitation in a low pressure fuel supply pipe such as the fuel passage 14. Further, the supply of fuel from the fuel pump to the delivery pipe 2 can stably be conducted and an adverse effect to the performance of the internal combustion engine is avoidable.

Further, since the orifice 33 is formed in the relief passage 20, the pressurized fuel in the pressurizing chamber 24 is discharged to the fuel passage 14 through the orifice 33 to reduce the pressure pulsation in the fuel passage 14, whereby the occurrence of noises or a mechanical stress can further be reduced. The connecting point of the relief passage 20 to the fuel passage 14 to discharge the pressurized fuel should be close to the pressure damper 30 since it is effective to suppress a pressure pulsation. Further, the connecting point should be at a side of the intake valve 15 with respect to the pressure damper 30 since the pressure pulsation applied to the fuel pipe such as the fuel passage 7 can be reduced and it is easy to form the damper chamber 29 integrally with the fuel pump 3.

Embodiment 2

Figure 3:
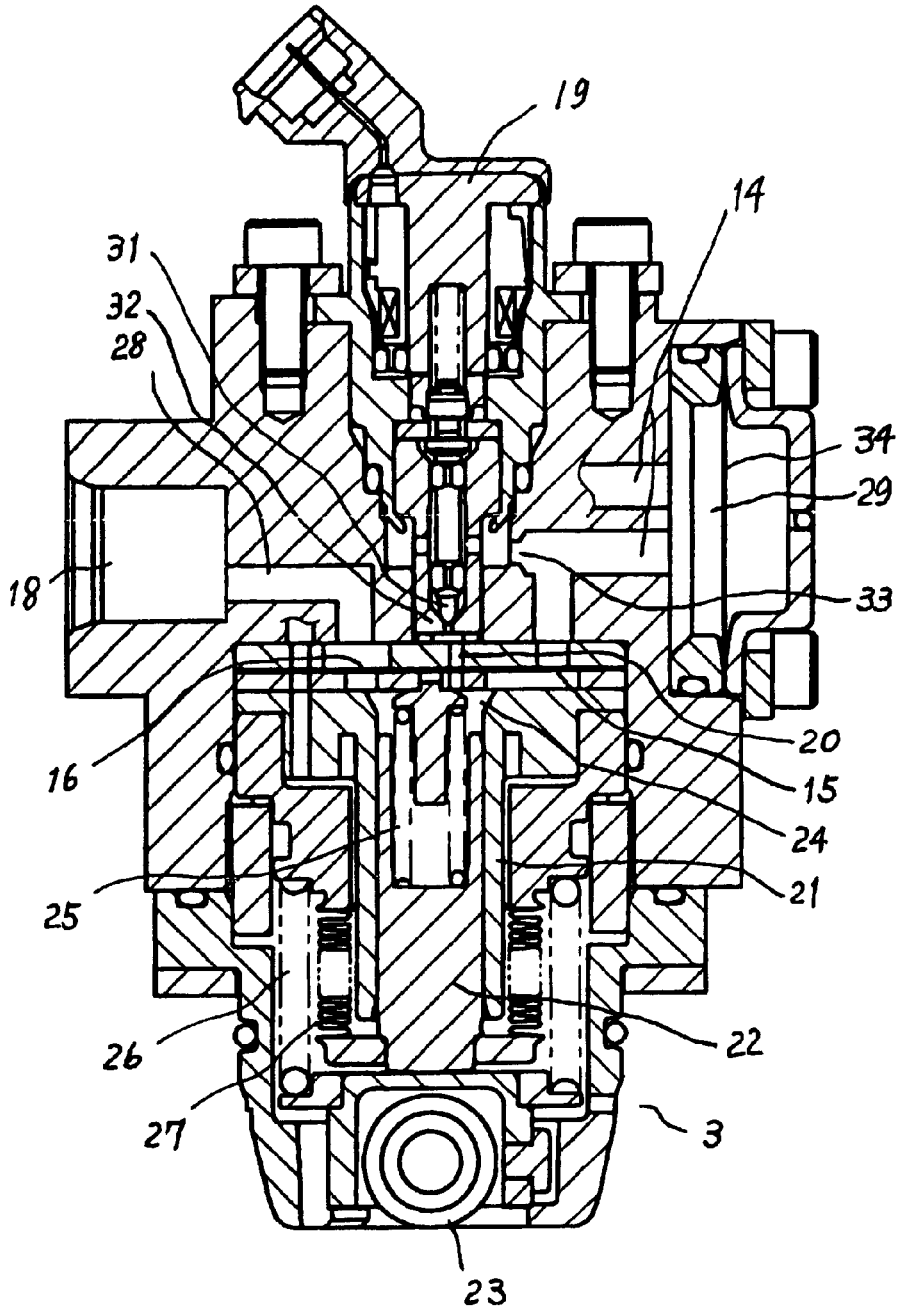
FIG. 3 is a cross-sectional view of a fuel pump used for the variable delivery fuel supply device according to a second embodiment of the present invention.
Figure 4:
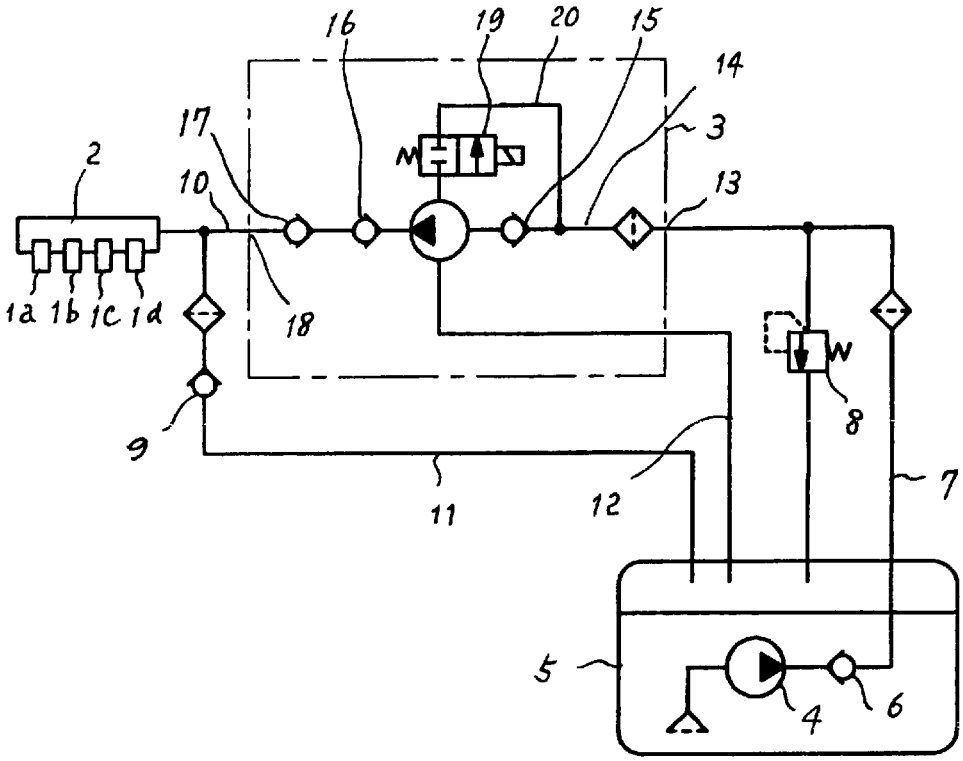
FIG. 4 is a systematic diagram showing the construction of a conventional variable delivery fuel supply device.

The variable delivery fuel supply device according to a second embodiment of the present invention will be described with reference to FIG. 3. The construction of the second embodiment is substantially the same as that of the first embodiment except that a pressure damper 34 is formed of a diaphragm. In this case too, the same effect is obtainable. In the second embodiment, the size of the damper chamber 29 can be reduced and the integrally formed fuel pump 3 can be small in size. Further, it is preferable to use a metallic diaphragm since a relatively high pressure is frequently applied to the diaphragm of the pressure damper 34.

As described above, according to the variable delivery fuel supply device of the present invention, the damper chamber is formed so as to be connected to the fuel passage at a position between the fuel intake port and the intake valve in the fuel pump; the pressure damper formed of a metallic bellows or a metallic diaphragm is disposed in the damper chamber, and pressurized fuel in the pressurizing chamber is relieved to the fuel passage between the damper chamber and the intake valve. Accordingly, it is possible to suppress a pressure pulsation of the pressurized fuel due to the relieving and to eliminate the occurrence of noises and a damage of the fuel pipe. Thus, the variable delivery fuel supply device of highly reliable and capable of conducting a stable fuel supply is obtainable.

Obviously, numerous modifications and variations of the present invention are possible in light of the above teachings. It is therefore to be understood that within the scope of the appended claims, the invention may be practiced otherwise than as specifically described herein.

The entire disclosure of Japanese Patent Application JP2000-55337 filed on Mar. 1, 2000 including specification, claims, drawings and summary are incorporated herein by reference in its entirety.

What is claimed is:

1. A variable delivery fuel supply device which comprises:

a fuel injection valve for injecting fuel to respective cylinders of an internal combustion engine, a fuel pump which sucks fuel from a fuel intake port through an intake valve into a pressurizing chamber by a reciprocating movement of a plunger in a cylinder to pressurize the fuel and supplies the pressurized fuel into the fuel injection valves through a discharge valve, a damper chamber having a pressure damper, which is communicated with the fuel passage at a position between the fuel intake port and the intake valve in the fuel pump, a relief passage for communicating the pressurizing chamber of the fuel pump with said fuel passage, and an electromagnetic valve for opening and closing the relief passage, which is adapted to control an amount of pressurized fuel to be supplied to the fuel injection valves by relieving pressurized fuel in the pressurizing chamber to said fuel passage at the time of opening the valve, wherein the damper chamber having a pressure damper is formed integrally with the fuel pump, and wherein the relief passage is communicated with the fuel passage between the damper chamber, including a pressure damper, and the intake valve.

2. A variable delivery fuel supply device which comprises:

a fuel injection valve for injecting fuel to respective cylinders of an internal combustion engine, a fuel pump which sucks fuel from a fuel intake port through an intake valve into a pressurizing chamber by a reciprocating movement of a plunger in a cylinder to pressurize the fuel and supplies the pressurized fuel into the fuel injection valves through a discharge valve, a damper chamber having a pressure damper, which is communicated with the fuel passage at a position between the fuel intake port and the intake valve in the fuel pump, a relief passage for communicating the pressurizing chamber of the fuel pump with said fuel passage, and an electromagnetic valve for opening and closing the relief passage, which is adapted to control an amount of pressurized fuel to be supplied to the fuel injection valves by relieving pressurized fuel in the pressurizing chamber to said fuel passage at the time of opening the valve, wherein an orifice is formed in the relief passage, and wherein the orifice is disposed at the connecting point of the relief passage to the fuel passage between a location where the damper chamber communicates with the fuel passage and the intake valve.

3. A variable delivery fuel supply device which comprises:

a fuel injection valve for injecting fuel to respective cylinders of an internal combustion engine, a fuel pump which sucks fuel from a fuel intake port through an intake valve into a pressurizing chamber by a reciprocating movement of a plunger in a cylinder to pressurize the fuel and supplies the pressurized fuel into the fuel injection valves through a discharge valve, a damper chamber having a pressure damper, which is communicated with the fuel passage at a position between the fuel intake port and the intake valve in the fuel pump, a relief passage for communicating the pressurizing chamber of the fuel pump with said fuel passage, and an electromagnetic valve for opening and closing the relief passage, which is adapted to control an amount of pressurized fuel to be supplied to the fuel injection valves by relieving pressurized fuel in the pressurizing chamber to said fuel passage at the time of opening the valve, wherein the damper chamber having a pressure damper is formed integrally with the fuel pump, wherein an orifice is formed in the relief passage, and wherein the orifice is disposed at the connecting point of the relief passage to the fuel passage between a location where the damper chamber communicates with the fuel passage and the intake valve.

4. A variable delivery fuel supply device which comprises:

a fuel injection valve for injecting fuel to respective cylinders of an internal combustion engine, a fuel pump which sucks fuel from a fuel intake port through an intake valve into a pressurizing chamber by a reciprocating movement of a plunger in a cylinder to pressurize the fuel and supplies the pressurized fuel into the fuel injection valves through a discharge valve, a damper chamber having a pressure damper, which is communicated with the fuel passage at a position between the fuel intake port and the intake valve in the fuel pump, a relief passage for communicating the pressurizing chamber of the fuel pump with said fuel passage, and an electromagnetic valve for opening and closing the relief passage, which is adapted to control an amount of pressurized fuel to be supplied to the fuel injection valves by relieving pressurized fuel in the pressurizing chamber to said fuel passage at the time of opening the valve, wherein the relief passage is communicated with the fuel passage between the damper chamber including a pressure damper and the intake valve, wherein an orifice is formed in the relief passage, and wherein the orifice is disposed at the connecting point of the relief passage to the fuel passage between a location where the damper chamber communicates with the fuel passage and the intake valve.

5. A variable delivery fuel supply device which comprises:

a fuel injection valve for injecting fuel to respective cylinders of an internal combustion engine, a fuel pump which sucks fuel from a fuel intake port through an intake valve into a pressurizing chamber by a reciprocating movement of a plunger in a cylinder to pressurize the fuel and supplies the pressurized fuel into the fuel injection valves through a discharge valve, a damper chamber having a pressure damper, which is communicated with the fuel passage at a position between the fuel intake port and the intake valve in the fuel pump, a relief passage for communicating the pressurizing chamber of the fuel pump with said fuel passage, and an electromagnetic valve for opening and closing the relief passage, which is adapted to control an amount of pressurized fuel to be supplied to the fuel injection valves by relieving pressurized fuel in the pressurizing chamber to said fuel passage at the time of opening the valve, wherein the relief passage is disposed such that fuel which is relieved enters into the fuel passage at a position downstream of the damper chamber.

6. The variable delivery fuel supply device according to claim 5, wherein the damper chamber having a pressure damper is formed integrally with the fuel pump.

7. The variable delivery fuel supply device according to claim 5, wherein the relief passage is communicated with the fuel passage between the damper chamber including a pressure damper and the intake valve.

8. The variable delivery fuel supply device according to claim 6, wherein the relief passage is communicated with the fuel passage between the damper chamber, including a pressure damper, and the intake valve.

9. The variable delivery fuel supply device according to claim 5, wherein an orifice is formed in the relief passage.

10. The variable delivery fuel supply device according to claim 6, wherein an orifice is formed in the relief passage.

11. The variable delivery fuel supply device according to claim 7, wherein an orifice is formed in the relief passage.

12. The variable delivery fuel supply device according to claim 5, wherein the pressure damper is formed of metallic bellows.

13. The variable delivery fuel supply device according to claim 5, wherein the pressure damper is formed of a metallic diaphragm.

14. The variable delivery fuel supply device according to claim 9, wherein the orifice is disposed at the connecting point of the relief passage to the fuel passage between a location where the damper chamber communicates with the fuel passage and the intake valve.

15. The variable delivery fuel supply device according to claim 9, wherein the orifice formed in the relief passage is opened at a downstream side of the fuel passage with respect to the pressure damper.

16. The variable delivery fuel supply device according to claim 10, wherein the orifice is disposed at the connecting point of the relief passage to the fuel passage between a location where the damper chamber communicates with the fuel passage and the intake valve.

17. The variable delivery fuel supply device according to claim 10, wherein the orifice formed in the relief passage is opened at a downstream side of the fuel passage with respect to the pressure damper.

18. The variable delivery fuel supply device according to claim 11, wherein the orifice is disposed at the connecting point of the relief passage to the fuel passage between a location where the damper chamber communicates with the fuel passage and the intake valve.

19. The variable delivery fuel supply device according to claim 11, wherein the orifice formed in the relief passage is opened at a downstream side of the fuel passage with respect to the pressure damper.

* * * * *